United States Patent [19]

De Vargas et al.

[11] Patent Number: 4,805,246

[45] Date of Patent: Feb. 21, 1989

[54] TOILET SEAT HANDLE

[76] Inventors: Angela De Vargas; John M. Casement, both of 825 8th Pl., Hermosa Beach, Calif. 90254

[21] Appl. No.: 140,639

[22] Filed: Jan. 4, 1988

[51] Int. Cl.[4] ..... A47K 13/10

[52] U.S. Cl. ..... 4/251; 4/231; 4/237; 4/661

[58] Field of Search ..... 4/661, 231, 237, 251, 4/248, 233

[56] References Cited

U.S. PATENT DOCUMENTS

| | | | |
|---|---|---|---|
| 1,999,555 | 4/1935 | Adams | 4/251 |
| 2,758,315 | 8/1956 | Hylton | 4/251 |
| 3,191,193 | 6/1965 | Bogenberger | 4/251 |
| 3,588,921 | 6/1971 | Nagel | 4/661 |
| 3,717,884 | 2/1973 | Mantooth | 4/251 X |
| 3,783,455 | 1/1974 | Vanderbrook | 4/237 |
| 3,935,601 | 2/1976 | Hermann | 4/251 |
| 4,512,046 | 4/1985 | Riggle | 4/661 |

*Primary Examiner*—Henry K. Artis
*Attorney, Agent, or Firm*—Roger A. Marrs

[57] ABSTRACT

A handle attachable to the underside of a toilet seat is disclosed herein for the purpose of manually lifting or lowering the seat in a sanitary manner. The handle includes an elongated member having an attachment portion securable to the edge marginal region of the seat and a handle portion centilevered outwardly in position for grasping by the fingers of the user. A deodorant cake is mountable from the attachment portion and the handle portion, including a display area for carrying alpha/numeric or graphic representations in either flat, relief or raised orientation. A cover or sleeve may be inserted over the handle portion which is of sanitary composition or a band of sanitary material may be wrapped around the handle portion.

5 Claims, 1 Drawing Sheet

TOILET SEAT HANDLE

BACKGROUND OF THE INVENTION

. Field of the Invention

The present invention relates to sanitary devices and more particularly to a novel handle attachable to the underside of the toilet seat so that the user may readily raise and lower the seat without touching the seat itself.

2. Brief Description of the Prior Art

It has been the conventional practice to raise and lower toilet seats by manually grasping the edge and lifting or lowering the seat accordingly. The seat is generally hinged at its rear edge so that the seat can be rotated about the hinge pins from a usuable position on top of the bowl itself and a storage position where it is raised substantially vertically.

Some attempts have been made to provide lifting means for such seats that employ weighted lever mechanisms so that the seat is normally biased in either the up or down position. In other instances, a user intending to avoid touching of the seat, will use his feet, loose sticks or the like in order to raise or lower the seat. Obviously, problems have been encountered when employing such conventional means since the pivoting levers are expensive and difficult to install while using a person's shoe or stick is extremely rudimentary and is not always successful in raising or lowering the seat in a convenient manner and one which will not break or damage the seat.

Therefore, a long standing need has existed to provide a novel means for raising and lowering a toilet seat which will neither damage the seat nor utilize expensive parts and particularly, to provide a means for raising and lowering the seat which is sanitary. Also, decorative aspects of the means for raising and lowering are important as well as the ability of the device to hold a replaceable deodorant cake so that overall cleanliness and sanitation is preserved.

SUMMARY OF THE INVENTION

Accordingly, the above problems and difficulties are obviated by the present invention which provides a novel means for raising and lowering the seat on a toilet bowl, which is pivotally attached thereto, that incorporates an elongated handle having an attachment portion adhesively secured to the underside of the seat and including a handle portion which cantilevers outwardly from the edge of the seat for grasping by the fingers of the user. Means are provided for aligning the elongated member with the edge of the seat so that proper placement is indexed and registered and a display area on the handle portion is available for alpha/numeric or graphic rendering so that decorative appearance of the device is enhanced. Means are provided for detachably securing a deodorant cake to the attachment portion for added sanitary purposes.

It is to be understood that the display area on the handle portion may be used for displaying indicia or graphic renderings in relief, raised manner or for carrying indicia in a printed, silkscreen or the like manner. Also, attachment may be achieved by screws, tongue-in-groove relationship or adhesive taking the form of a tape or other adhesive coating.

Therefore, it is among the primary objects of the present invention to provide a novel device for raising and lowering the seat of a toilet which is simple, economical to manufacture and one which may readily be installed on conventional seats without skill or alteration of the toilet installation.

Another object of the present invention is to provide a novel handle means attachable to the underside of a seat so that it may be grasped by the fingers of the user and raised or lowered in a sanitary and convenient manner.

Another object of the present invention is to provide a novel handle means attachable to a pivoting seat whereby the user may raise or lower the seat without touching the seat itself and wherein the handle means may include decorative or ornamental graphic subject matter which is readily displayed in a preferred area on the handle.

Yet another object of the present invention is to provide a simple and economical means for raising and lowering a pivoted seat attached to a toilet bowl that is safe and sanitary and wherein the means includes the detachable carrying of a deodorant cake for a completely sanitary environment.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

DESCRIPTION OF THE PREFERRED EMBODIMENT

Figure 1:
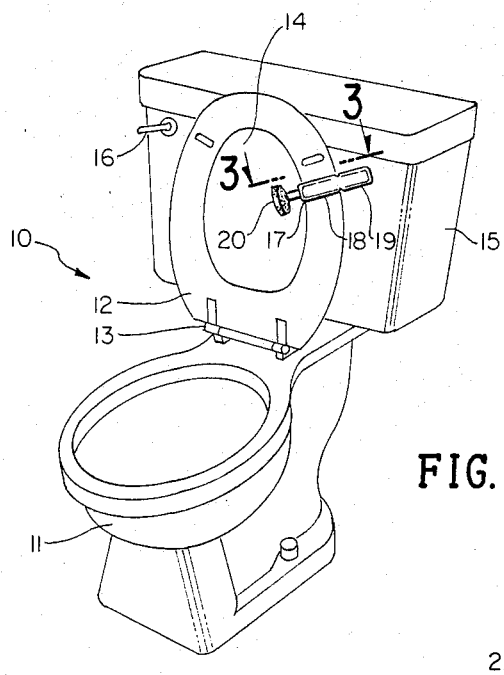
FIG. 1 is a perspective view of a typical toilet bowl seat installation incorporating the lifting means of the present invention.

Referring to FIG. 1, a conventional toilet bowl, seat and lid assembly, is shown in the general direction of arrow 10 which includes a bowl 11 on which a seat 12 is pivotally mounted via a pivot connection 13. A lid or cover 14 is also included and is spaced from the upper edge of the bowl 11 by seat 12. The tank for the bowl is indicated by numeral 15 and the flushing mechanism operable from a handle 16 is contained within the tank 15.

In one form of the invention, an elongated member 17 is attached to the underside of a portion of the seat 12 and includes an attachment portion 18 and a handle portion 19. The attachment portion 18 is secured to the underside of the seat by a plurality of devices or methods such as screws, staples, fasteners and/or adhesive, bonding agents or the like. The handle portion 19 is cantilevered outwardly on the edge marginal region of the seat 12 and projects outwardly so that it may be readily grasped by the fingers of the user during the lifting or lowering procedure.

The opposite end of the member 17 from its end carrying the handle portion includes a mounting means for detachably connecting with a disinfectant or deodorant cake 20. The deodorant cake is moved into and out of position with respect to the bowl 11 when the seat 12 is raised or lowered accordingly.

Figure 2:
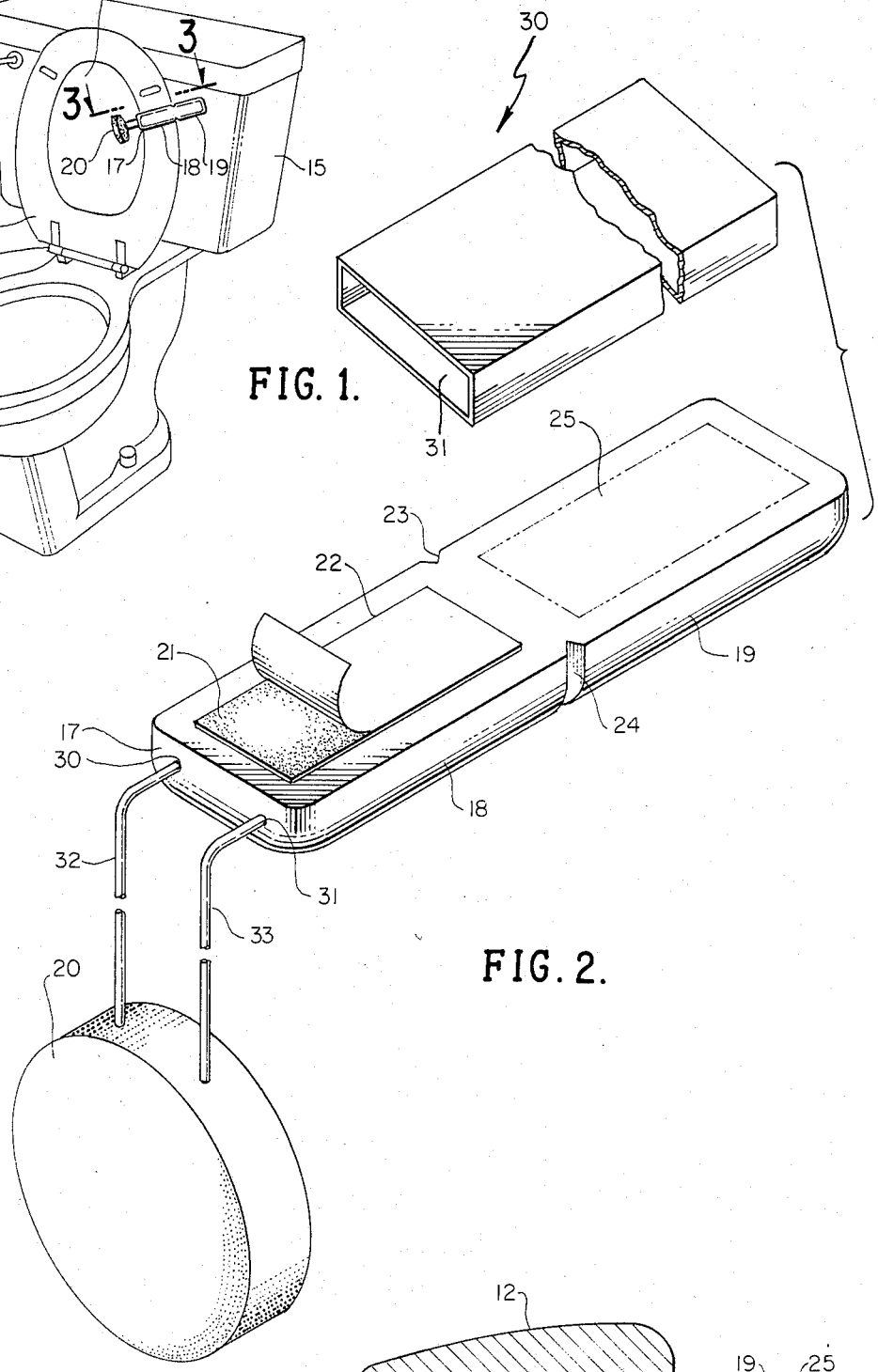
FIG. 2 is an enlarged perspective view of the handle means used for raising and lowering the seat shown in FIG. 1.

Referring now in detail to FIG. 2, the sanitary handle of the present invention is further illustrated wherein a double-sized adhesive tape 21 is illustrated having one side attachable to the attachment portion 18 of the member 17 within an attachment area identified between the broken lines 22. The opposite side of tape 21 from the side attached to area 22 is also adhesively coated so that it may be readily attached to a selective area on the underside of a portion of the seat 12. Preferably, the member 17 is attached so that the user may readily grasp the handle portion with his right or left hand.

The handle portion 19 is separated from the attachment portion 18 by means of a pair of notches 23 and 24 associated with each side of the member 17. These notches provide a visual registration or index marker so that the user may line the edge of the seat 12 with the notches so that the handle portion extends outwardly from the outer edge of the seat. The upper surface of the handle portion 19 includes a display area 25 for mounting a variety of alpha/numeric indicia or graphic representations. Such indicia or representations may be in relief, raised or flush with the flat surface of the handle member, as desired. An example of a raised rendering would be that of a flower, fish or the like whereas a relief representation could include similar subject matter but below the surface of the handle portion. Examples of display information that would be flush with the flat portion include printed surface matter, detail or the like. Also, it is to be understood that the thickness of the member 17 is of sufficient proportion to maintain the member rigid; however, the underside of member 17 may be hollowed or constructed in relief with reinforcing ribs so that a lightweight construction is produced. It is important that the member 17 be rigid and substantially reinforced at its midsection so that it will not bend or break during repeated usage.

The disinfectant cake 20 may or may not be incorporated with the member 17. The cake may take the form of a circular configuration as illustrated, which is mounted into a pair of holes 30 and 31 by means of a pair of wire mounts illustrated by numerals 32 and 33 respectively. Once the cake has been used up to where it is no longer effective, the wires 32 and 33 may be disengaged from the holes 30 and 31 and discarded wherein a replacement cake is introduced by inserting the ends of the wires 32 and 33 into the receptacle holes 30 and 31. It is also to be understood that other means and ways of mounting the disinfectant or deodorant cake onto the member 17 are envisioned. Such other means may include a tongue-in-groove arrangement provided in the end of the member 17 so that the cake is readily insertable and removable when used up. Also, the member 17 may be composed of any simple material, such as wood, plastic or the like.

Figure 3:
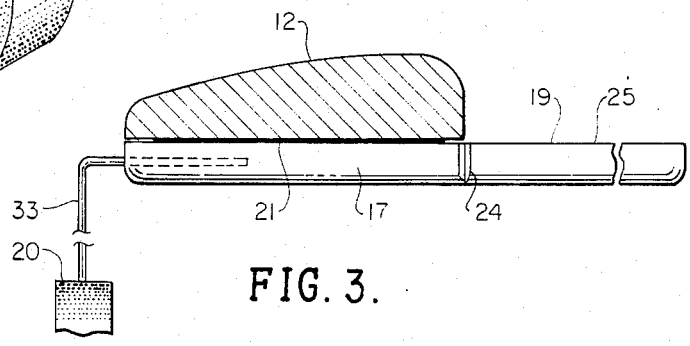
FIG. 3 is a transverse cross-sectional view of the handle means installed on the seat as taken in the direction of arrows 3—3 of FIG. 1.

Referring now in detail to FIG. 3, a cross-section is shown wherein the member 17 is attached to the underside of the seat 12 and outwardly projects so that the handle portion 25 extends in a convenient position for grasping by the hand of the user. The hand of the user never touches the seat 12 and, therefore, presents a safe and sanitary environment. The notches, such as notch 24, properly align the member 17 with the outer edge of the seat 12, and the adhesive 21 secures the member 17 to the underside. The deodorant or disinfectant cake 20 is suspended from the opposite end of member 17 from its end carrying the handle portion 19 and, in the present application, extends downwardly so as to enter the interior of the bowl 11. Again, it is to be understood that other types of deodorant or disinfectant materials may be mounted on the handle portion 19 or on the attachment portion 17.

For example, a sleeve 30 may be used by inserting the handle portion 19 into the cavity 31 of the sleeve. The sleeve or cover may be composed of sanitized paper, cardboard, plastic or the like. The length of the cover or sleeve is no longer than the length of the handle portion. Also, the cover or sleeve may take the form of a hand encircling a part of the handle portion.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A toilet seat handle for attachment to the undersurface of a toilet seat comprising:

an elongated member having opposite end portions separated by a midsection;

means for attachably securing a selected end portion of said member to the toilet seat undersurface;

said end portion opposite to said selected end portion cantilevered outwardly to project from the peripheral edge of the seat constituting a handle intended for grasping by the fingers of a user, the upper surface of which includes a display area for mounting a variety of Alpha/numeric indicia or graphic representations;

means carried on said member midsection for registering or indexing said member with respect to the toilet seat edge so that said handle extends outwardly laterally from the toilet seat edge;

a deodorant means detachably carried inwardly and downwardly of said toilet bowl seat when said toilet bowl seat is in an in-use position on said attachment selected end portion of said member; and said registering or indexing means includes pair of notches carried on opposite sides of said member midsection separating said display area from said securement means.

2. The invention as defined in claim 1 wherein:

said handle includes an exposed display area for carrying alpha/numeric indicia and graphic representation.

3. The invention as defined in claim 1 wherein:

said securement means is an adhesive or bonding substance.

4. The invention as defined in claim 1 including:

a cover for said handle portion composed of a sanitary material.

5. The invention as defined in claim 4 wherein:

said cover is a band encircling said handle portion or an elongated sleeve conformal in configuration to said handle portion.

* * * * *